US005165824A

United States Patent [19]

Corcoran et al.

[11] Patent Number: 5,165,824

[45] Date of Patent: Nov. 24, 1992

[54] ELONGATED SHORING DEVICE

[76] Inventors: Dan M. Corcoran, 10 E. 800 North; Michael V. Orton, 302 W. 100 South, both of Manti, Utah 84602

[21] Appl. No.: 654,283

[22] Filed: Feb. 11, 1991

[51] Int. Cl.[5] ..... E21D 15/14

[52] U.S. Cl. ..... 405/288; 248/354.2; 405/303

[58] Field of Search ..... 405/290, 288, 303; 248/354.2

[56] References Cited

U.S. PATENT DOCUMENTS

| | | | |
|---|---|---|---|
| 1,765,200 | 6/1930 | Bullough | 405/290 X |
| 1,895,053 | 1/1933 | Staley | 248/354.2 |
| 2,510,688 | 6/1950 | Evans et al. | 405/290 X |
| 2,886,875 | 5/1959 | Anderson | 248/354.2 X |
| 3,830,468 | 8/1974 | Whitchurch et al. | 248/354.2 X |
| 4,167,361 | 9/1979 | Petro et al. | 405/290 |

FOREIGN PATENT DOCUMENTS

| | | | |
|---|---|---|---|
| 0087178 | 1/1958 | Netherlands | 248/354 |

*Primary Examiner*—Dennis L. Taylor
*Attorney, Agent, or Firm*—Terry M. Crellin

[57] ABSTRACT

An elongate shoring device capable of supporting a high longitudinal loading with the ability to yield uniformly in a direction along the longitudinal dimension of the shoring device when the longitudinal loading on the shoring device exceeds a preset magnitude. The shoring device comprises an inner elongate tube which is received within an open end of an outer elongate tube for longitudinal, telescopic movement within the outer tube. A storage compartment having a variable volume is formed by the inner and outer tube when the inner tube is received through the open end of the outer tube, with the volume of the storage compartment decreasing as the inner tube moves in its longitudinal, telescopic movement into the outer tube. A solid, non-compressible material is contained in the storage compartment, and a relief opening is provided in communication with the storage compartment. The solid material allows the inner and outer tubes to sustain longitudinal loading up to a preset magnitude, and when the longitudinal loading exceeds the preset magnitude, the shoring device yields uniformly along its longitudinal dimension as a result of a portion of the solid material being ejected from the storage compartment through the relief opening thereby allowing the inner tube to move further into the outer tube.

7 Claims, 2 Drawing Sheets

ELONGATED SHORING DEVICE

BACKGROUND OF THE INVENTION

1. Field of the Invention

The present invention relates to shoring devices used mainly in underground mines for supporting the roofs of such mines.

2. State of the Art

A problem in underground mining is stabilizing excavations in highly yielding rock masses. After the excavation is made, the surrounding strata squeezes into the entry, causing rib sloughing, roof sag, and floor heave. The squeeze reduces the area available for ventilation and creates a more formidable escape path. One type of mining susceptible to highly yielding ground conditions is longwall coal mining. The entries created to facilitate longwall mining in many cases are subjected to various load stages. These can include the stage when entry is initially developed, when the longwall face proceeds along the entry during its use as a headgate, and when the adjacent longwall panel is mined and the entry is used as a tailgate.

Traditionally, mine operators have used wood timbers and cribbing to support roofs of the mining excavations. Timbers and cribbing are generally effective in supporting the necessary loading, and cribbing will generally yield when subjected to excessive loading. In this respect, wood timbers and cribbing approach being an ideal roof support. Such ideal supports would be able to handle high loading and yet have the ability to yield uniformly when subjected to excessive loading rather than abruptly fail.

Wood timbers and cribbing do, however, have some serious disadvantages. Although heretofore wood timers and cribbing have been generally inexpensive, wood is becoming more scarce and the cost is ever going higher and higher. In addition, regardless of how wood is used, its strength varies with the individual piece and a structure made from wood, such as a crib, is only as strong as its weakest piece. Further, ventilation in mines is of important consideration, and the bulkiness of wooden cribs and posts reduces the amount of air flow.

It has been recognized that it would be highly desirable to produce a simple substitute post support or elongate shoring device to replace wood timbers. Such an elongate shoring device should desirably have equal or greater load bearing capacity than wood timbers as well as the ability to consistently yield in a uniform manner when subjected to excessive loads. It would be further desirable if such a shoring device would be easily and generally inexpensive to install in a mine.

In the March, 1987 edition of Coal Age, it was reported that the Bureau of Mines had developed a yielding steel post for replacement of wood timbers in underground mines. The post mechanism was a three piece unit consisting of a top and bottom leg made from standard steel pipe and a separate foot bracket. One leg telescopes into the other, and an interference ring is welded to the outside diameter of the smaller pipe. As the two pieces of pipes are forced together longitudinally, the ring engages the outer pipe and causes the larger pipe to flare outwardly and deform radially. The action is similar to the extrusion process for manufacturing seamless pipe.

Unfortunately, however, due to the critical dimensions required by the inside diameter of the larger pipe and the size of the interference ring on the smaller pipe, the costs of the steel pipe shoring units was rather high. Even then, consistency from unit to unit was hard to obtain. The pipes had a tendency to seize and buckle rather than yield under high load. In addition, rather than flare and deform radially outwardly as designed, the outer pipe often failed along its seam line. The flaring, deforming pip system as reported by the Bureau of Mines has not been used commercially to any significant amount.

3. Objectives

A principal objective of the invention is to provide a novel, elongate shoring device constructed from telescoping pipe sections, with a non-compressible solid material contained in a compartment formed between the two telescoping pipe segments that sustains and distributes the load between the two sections of pipe rather than frictional and radial deformation forces acting on the pipe as in the units reported by the Bureau of Mines mentioned previously. The novel shoring devices of the present invention are provided with a relief opening that allows the non-compressible to be ejected from the compartment thereby allowing the pipe sections to yield in a uniform manner longitudinally along the length of the pipe units while continuing to provide maximum load bearing support.

An additional objective is to provide such an elongate shearing device further having additional advantages as follows:

(1) The devices of the present invention are not flammable and are much less bulky than timber crib type shoring. The less bulky devices of the present invention allow more adequate air flow in the mine shaft.

(2) The devices of the present invention are inexpensive, easy to install in the mine, and shipping costs are considerably less than with conventional crib type shoring.

(3) The yield and closure characteristics of the devices of the present invention are uniform and easily controlled.

(4) The overall cost of installing the shoring devices of the present invention is significantly less than the total cost, including materials and extensive labor, realized in installing conventional crib type shoring.

(5) Manufacturing of the shoring devices of the present invention is inexpensive, utilizing commercially available pipe that need not be made to rigid specifications beyond those of ordinary, standard pipe that is used widely and is readily available throughout the world.

BRIEF DESCRIPTION OF THE INVENTION

The above objectives are achieved in accordance with the present invention by providing novel, unique shoring device comprising at least two elongate tubes. One of the tubes is undersized so that it can readily be received telescopically within the larger tube. Machining of the tubes to obtain precise fit of the inner tube in the outer tube is not necessary. The inner tube can be sufficiently undersized so that it slides readily within the outer tube. Commercial steel pipe is preferably used, with the outer pipe being of a sufficient size that the inner pipe slides easily within the outer pipe.

A storage compartment is formed between the telescoping tubular members, with the volume of the storage compartment decreasing as the inner tube moves in its longitudinal, telescopic movement relative to the outer tube. A solid, non-compressible material is contained and trapped in the storage compartment. As loading is developed at the opposite ends of the elongate shoring device, the load is distributed and sustained between the telescoping members by the solid, non-compressible material.

The telescoping members and the non-compressible, solid material contained in the storage compartment sustain loads up to a preset magnitude. When longitudinal loading in excess of the preset magnitude occurs, a relatively small portion of the non-compressible, solid material is ejected from a relief opening that is in communication with the storage compartment. As non-compressible, solid material is ejected from the storage compartment, the inner tube is allowed to yield in a uniform movement by telescopically moving further into the outer tube. The load bearing qualities of the shoring device are continuously maintained as the device yields. The shoring device maintains its normal loading until loads in excess of the preset magnitude again occur. The yielding action is then repeated. This yielding action can reoccur numerous times, with the shoring device continuously providing support for the roof of the mine.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 4:
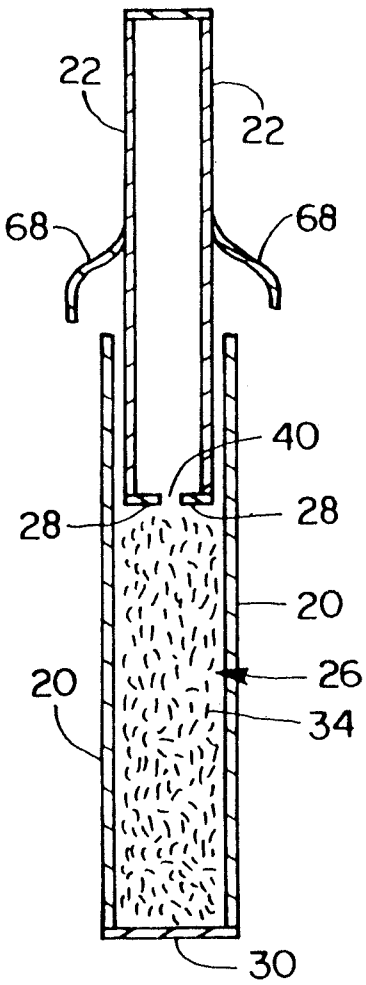
FIG. 4 is a horizontal cross section through a fourth preferred embodiment of an elongate shoring device in accordance with the present invention.

There are shown in the drawings several preferred embodiments of an elongate shoring device in accordance with the present invention. In describing the various embodiments of the invention, like parts in different figures of the drawings will be referred to with the same reference numerals.

The elongate shoring device of the present invention, as mentioned previously, is capable of sustaining high longitudinal loading with the ability to yield uniformly in a direction along the longitudinal dimension of the shoring device when the longitudinal loading on the shoring device exceeds a preset magnitude. The shoring device generally comprises an outer elongate tube 20 having first and second ends, with at least the first end of the outer tube 20 being open. An inner elongate tube 22 is received through the open end of the outer tube 20 for longitudinal, telescopic movement toward the second end of the outer tube 20.

In the embodiments illustrated in FIGS. 1 through 5, the outer tube 20 is the lower tube and its lower end is positioned on the floor of the mining excavation. The inner tube 22 fits downwardly into the open upper end of the outer, lower tube 20, with the upper end of the inner tube 22 abutting the ceiling of the mining excavation. In the embodiments shown in FIGS. 6 and 7, the outer tube 20 is the upper tube that abuts the ceiling of the excavation, and the inner tube 22 is the lower tube whose lower end is positioned on the floor of the excavation.

A storage compartment 26 having a variable volume is formed by at least one of the inner and outer tubes 22 and 20 when the inner tube 22 is received through the open end of the outer tube. The volume of the storage compartment 26 decreases as the inner tube 22 moves in its longitudinal, telescopic movement toward the second end of the outer tube 20.

Figure 7:
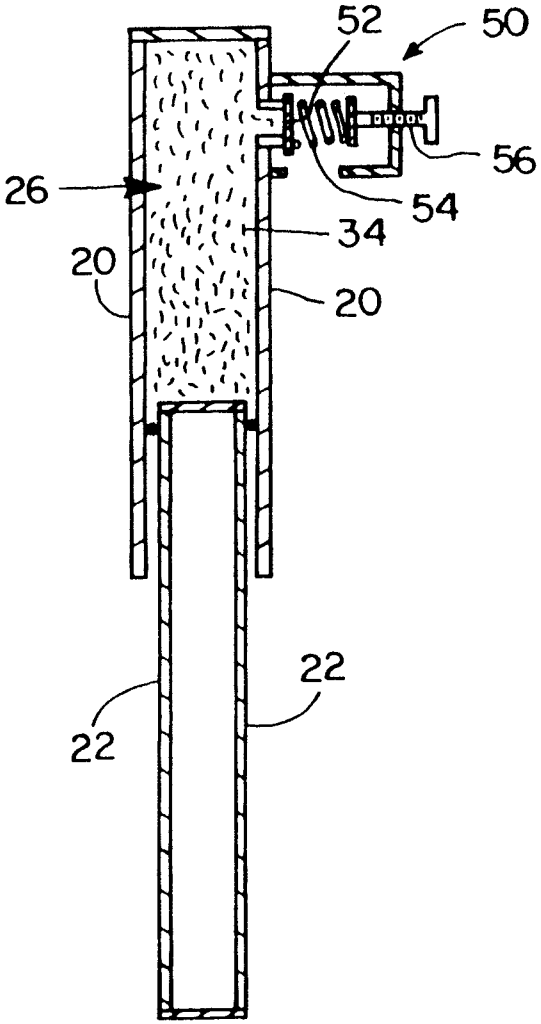
FIG. 7 is a horizontal cross section through a seventh preferred embodiment of an elongate shoring device in accordance with the present invention.

In the embodiments of the shoring device of the present invention as shown in FIGS. 1 through 4 and 7 of the drawings, the storage compartment 26 is formed by the sidewall of the outer tube 20. The upper end of the storage compartment 26 of the embodiments shown in FIGS. 1 through 4 is formed by a plate 28 closing the end of the inner tube 22 which is received telescopically into the open end of the outer tube 20. The lower end of the storage compartment 26 of the embodiments shown in FIGS. 1 through 4 is formed by a plate 30 that closes the bottom end of the outer tube 20. In the embodiment of the shoring device as shown in FIG. 7, the outer tube 20 is the upper member and has its open end facing downwardly, with the plate 30 that closes the other end of the outer tube 20 abutting against the ceiling of the excavation. The storage compartment 26 is still formed in the outer tube 20, but its upper end is now formed by the plate 30 that closes the upper end of the outer tube 20, and its lower end is formed by the plate 28 that closes the upper end of the inner tube 22.

Figure 6:
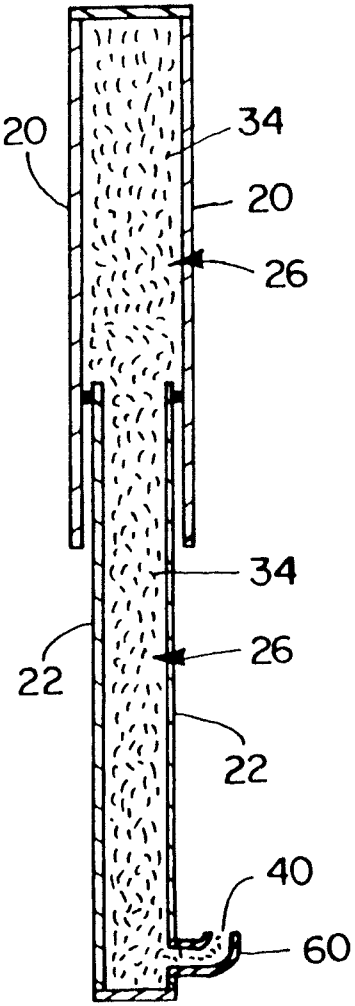
FIG. 6 is a horizontal cross section through a sixth preferred embodiment of an elongate shoring device in accordance with the present invention.
Figure 5:
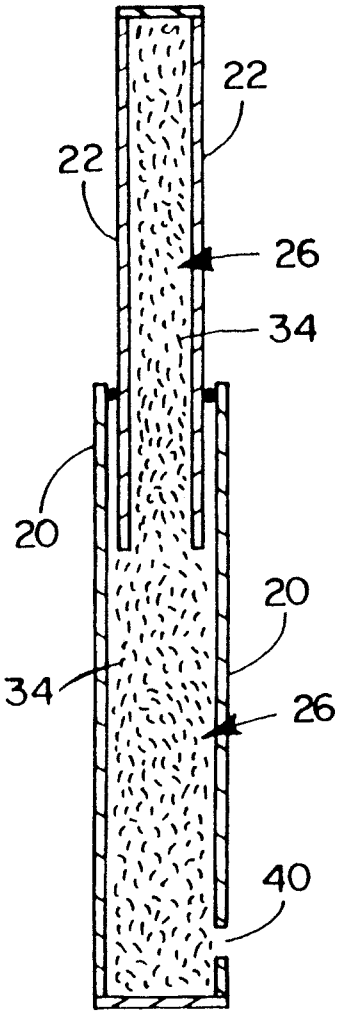
FIG. 5 is a horizontal cross section through a fifth preferred embodiment of an elongate shoring device in accordance with the present invention.

In the embodiments of the shoring device of the present invention shown in FIGS. 5 and 6, the storage compartment 26 comprises the entire inner volumes of the outer and inner tubes 20 and 22. The upper ends of the storage compartment 26 in these embodiments is formed by either the plate 28 or 30 of the inner or outer tube 22 or 20 whichever abuts the ceiling of the excavation, and the lower ends of the storage compartment 26 is the other plate 28 or 30 whichever rests on the floor of the excavation.

In the embodiment of the shoring device of the present invention shown in FIG. 5, the inner tube 22 is the upper tube, and the plate 28 at the closed upper end of the inner tube 22 forms the upper end of the storage compartment 26. In this embodiment, the outer tube 20 is the lower tube, and the plate 30 at the closed bottom end of the outer tube 20 forms the lower end of the storage compartment 26.

In the embodiment of the shoring device of the present invention shown in FIG. 6, the inner tube 22 is the lower tube. The outer tube 20 is the upper tube and the plate 30 of the outer tube 20 forms the upper end of the storage compartment 26. Further, the plate 28 of the inner tube 22 forms the lower end of the storage compartment 26.

The storage compartment 26 of the shoring device of the present invention is filled with a solid, non-compressible material 34. The material 34 can advantageously be a particulate material such as small metal balls that have a rounded surface. Preferably, the particulate material is small steel balls. The solid non-compressible material can also be made of a material that will exhibit plastic flow when subjected to sufficient shear force. The purpose of using small particulate material having rounded surfaces or material that will exhibit plastic flow at high shear force as the material 34 contained in the storage compartment 26 will become more understandable in the following further description of the shoring device of the present invention.

It can be seen at this point in the description, that the material 34 in the storage compartment 26 sustains much of the loading applied to the shoring device and further distributes the loading between the two telescoping tubes 20 and 22 in a manner to provide maximum strength. Exceptionally high loading can be obtained using common schedule 40 or schedule 80 steel pipe as the tubes 20 and 22. Special tubing need not be used. However, tubing of other shapes than steel pipe could be used if available at an economically feasible cost.

To obtain a uniform yield in the longitudinal length of the shoring device of the present invention when it is subjected to a preset magnitude of longitudinal loading, a relief opening is provided in communication with the storage compartment 26. When the shoring device is subjected to such a preset magnitude of longitudinal loading, the solid, non-compressible material 34 is designed to be ejected, pushed from or otherwise extruded from the relief opening leading from the storage compartment 26. It can be understood now why the material 34 must have rounded surfaces if a particulate material is used or must otherwise exhibit plastic flow at a high shear force. When the forces on the non-compressible material 34 attains a specified magnitude, the material 34 must be able to be ejected, pushed from or otherwise extruded from the storage compartment 26 through the relief opening. As the material 34 in the storage compartment 26 is slowly and uniformly ejected, pushed from or extruded from the storage compartment 26 through the relief opening, the inner tube 22 can move slightly into the outer tube 20 to relieve and reduce the longitudinal loading on the shoring device.

Figure 2:
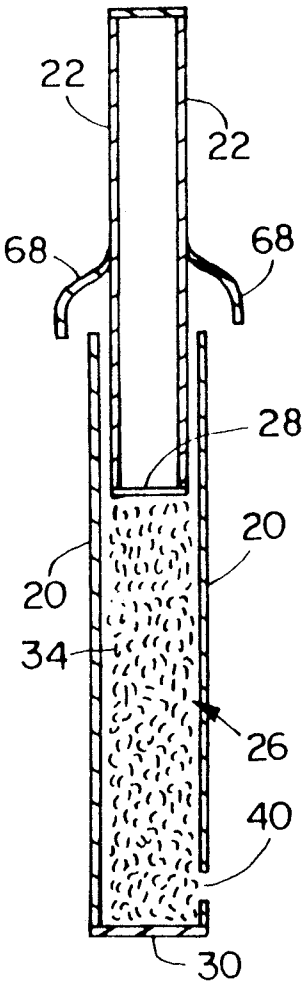
FIG. 2 is a horizontal cross section through a second preferred embodiment of an elongate shoring device in accordance with the present invention.

Various means can be utilized for or in combination with the relief opening for regulating the preset magnitude of the longitudinal loading on the shoring device. The relief device can be a simple orifice or opening 40 through a wall forming the storage compartment 26. Such openings 40 are shown in the embodiments of FIGS. 2 and 4. The openings 40 are sized as determined experimentally to allow the material 34 being utilized to pass through the openings 40 when the preset magnitude of longitudinal loading is sustained by the shoring device.

Figure 3:
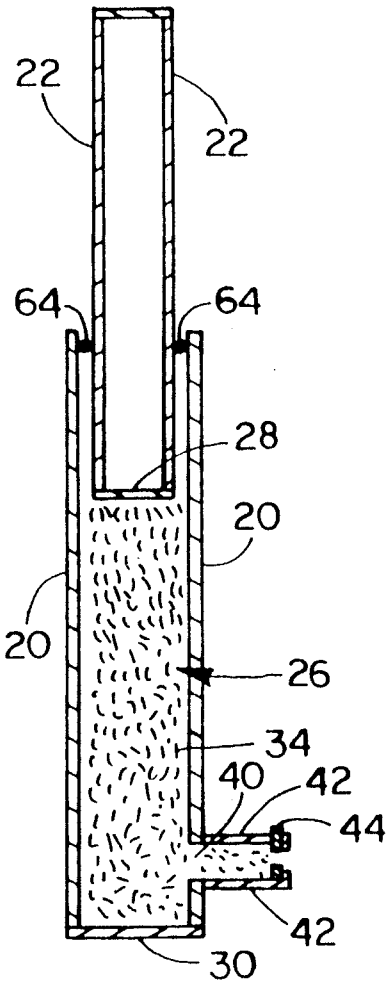
FIG. 3 is a horizontal cross section through a third preferred embodiment of an elongate shoring device in accordance with the present invention.

As shown in FIG. 3, the relief device comprises a short, open tube 42 in flow communication with the storage compartment 26. To provide an adjustable opening for use with different materials 34 of varying characteristics or to provide for adjusting the preset magnitudes of longitudinal loading to be allowed on the shoring device, replaceable discs 44 can be situated in the end of the tube 42. The discs 44 can have openings or orifices of different sizes to provide for different materials 34 used in the storage compartment 26 of the shoring device or to provide for adjusting the preset magnitude of longitudinal loading to be allowed on the shoring device.

To provide even more adjustment of the preset magnitude of longitudinal loading to be sustained by the shoring device, a relief valve 50 can be associated with the relief opening as shown in FIG. 7. The relief opening of this embodiment has a movable closure member 52 that is held against the opening by a spring 54. As the force in the material 34 builds sufficiently to push the closure member 52 in a direction against the spring bias, the material 34 can pass through the resulting opening. The spring force can be made adjustable by providing a screw adjustment 56 to increase or decrease the force exerted by the spring 54 against the closure member 52.

Figure 1:
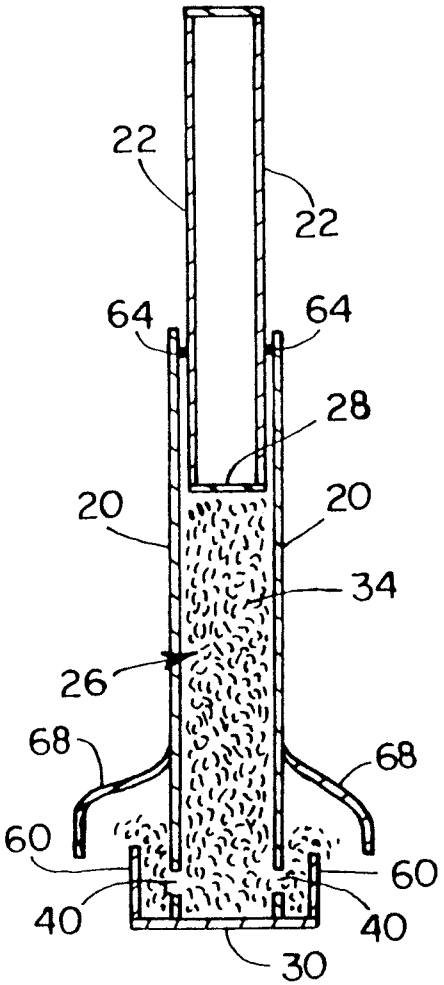
FIG. 1 is a horizontal cross section through one preferred embodiment of an elongate shoring device in accordance with the present invention.

Another alternative means for providing adjustment of the preset magnitude of longitudinal loading to be sustained by the shoring device of the present invention is shown in FIG. 1.

The end of the inner tube 22 which is received through the open end of the outer tube 20 is closed and the storage compartment is formed by the outer tube 20 between the closed end of the inner tube 22 and the bottom end of the outer tube 20. The relief opening is formed by an annular space around the second end of the outer tube 20 and a foot plate 30 at the bottom end of the outer tube 20. The means for regulating the preset magnitude of the longitudinal loading comprises a continuous cylindrical rim 60 extending upwardly from the foot plate 28 to circumscribe the annular space at the bottom end of the outer tube 20. The rim 60 is spaced radially from the outer tube 20, whereby when the preset loading has been achieved on the material 34 in the storage compartment 26, the material 34 is ejected from the annular space and then pushed upwardly through the cylindrical rim 60. By adjusting the height of the top of the rim 60, the force necessary to push material 34 from the storage compartment 26 can be increased or decreased.

As shown in FIG. 4 of the drawings, the end of the inner elongate tube 22 of the elongate shoring device is received through the lower open end of the outer tube 20 and that end is closed by the end plate 28. The storage compartment 26 is formed by the outer tube 20 between the closed end of the inner tube 22 and the lower, second end of the outer tube 20. The relief opening is formed by an annular orifice in the plate 28 of the closed end of the inner tube 22. As the preset magnitude of loading on the shoring device is attained, the material 34 in the storage compartment is ejected, pushed or otherwise extruded through the annular orifice into the empty space within the inner tube 22.

As shown in the embodiments of the shoring device of the present invention as illustrated in FIGS. 1, 3, 5, 6 and 7, an elastomeric O-ring 64 can be positioned between the inner and outer tubes 22 and 20. In the embodiments shown in FIGS. 1, 3 and 5, the O-rings 64 are positoned near the open end of the outer tube 20, while in the embodiments shown in FIGS. 6 and 7, the O-rings 64 are positioned near the end of the inner tube 22 that is received telescopically within the outer tube 20. The O-rings serve one of two principal functions depending upon the particular embodiment of the shoring device. They prevent the material 34 from falling between the tubes 22 and 20 when the storage compartment is located above the upper end of the lower tube as shown in the embodiment of FIGS. 6 and 7, and they prevent water from running downwardly between the tubes 22 and 20 in the other embodiments shown in FIGS. 1, 3 and 5.

Water seepage into the lower tube 20 of the embodiments shown in FIGS. 2 and 4 can also be prevented by providing a flashing 68 around the open end of the outer tube 20. The flashing 68 is preferably positioned on the inner tube 22 to extend outwardly and then downwardly beyond the open end of the outer tube 20.

To eliminate solid material from falling from the relief opening in the storage compartment in those embodiments wherein the relief opening is a simple orifice in the sidewall of one of the tubes, it is advantageous to provide an upwardly inclined collector extending from the relief opening that will retain the solid material. As shown in FIG. 6, the upwardly inclined collector comprises an upstanding nipple 60. Any solid material exiting the relief opening 40 must travel upwardly through the nipple 60. The nipple 60 could be a vertical standpipe as shown or it can slope upwardly at any disired angle. The solid material in the storage compartment cannot, of course, fall from the relief opening 40 under its own weight because of the small resistance offered by the upstanding nipple 60. When the device is subjected to the preset magnitude of loading, sufficient forces are then present to eject or push the solid material from the opening 40 and through the upstanding nipple 60.

Although preferred embodiments of the elongate shoring devices of the present invention have been illustrated and described, it is to be understood that the present disclosure is made by way of example and that various other embodiments are possible without departing from the subject matter coming within the scope of the following claims, which subject matter is regarded as the invention.

We claim:

1. An elongate shoring device which is capable of supporting a high longitudinal loading with the ability to yield uniformly in a direction along the longitudinal dimension of the shoring device when the longitudinal loading on the shoring device exceeds a preset magnitude, said shoring device comprising an outer elongate tube having a first end and a second end, with at least the first end of said outer tube being open:

an inner elongate tube which is received through the first, open end of said outer tube for longitudinal, telescopic movement toward the second end of said outer tube;

a storage compartment having a variable volume, said storage compartment being formed by the inner and outer tube when the inner tube is received through the open end of said outer tube, with the volume of the storage compartment decreasing as the inner tube moves in its longitudinal, telescopic movement toward said second end of said outer tube;

a solid material contained in the storage compartment so that the inner and outer tubes can sustain longitudinal loading:

a relief opening in communication with said storage compartment, wherein the relief opening allows a portion of said solid material to be ejected from the storage compartment through the relief opening when the longitudinal loading exceeds a preset, adjustable magnitude, with said ejection of material from said storage compartment allowing the shoring device to yield uniformly along its longitudinal dimension as a result of the inner tube moving toward the second end of the outer tube; and means associated with the relief opening for controlling the ejection of solid material through the relief opening to thereby regulate and maintain an adjustable, preset magnitude of longitudinal loading on said shoring device.

2. An elongate shoring device in accordance with claim 1, wherein the means for regulating the preset magnitude of the longitudinal loading comprises an orifice having a preset size positioned in said relief opening.

3. An elongate shoring device in accordance with claim 1, wherein the means for regulating the preset magnitude of the longitudinal loading comprises a relief valve associated with said relief opening.

4. An elongate shoring device in accordance with claim 1, wherein the end of the inner elongate tube which is received through the first open end of said outer tube is closed and the storage compartment is formed by the outer tube between the closed end of said inner tube and the second end of said outer tube;

the relief opening is formed by an annular space adjacent to the second end of said outer tube;

a foot plate is attached to and closes said second end of the outer tube; and the means for regulating the preset magnitude of the longitudinal loading comprises a continuous cylindrical rim extending upwardly from said foot plate to circumscribe the annular space adjacent to the second end of said outer tube, with said rim being spaced radially from said outer tube, whereby when the preset loading has been achieved on the solid material, it is ejected from said annular space and then upwardly over the top of the cylindrical rim.

5. An elongate shoring device in accordance with claim 1, wherein the end of the inner elongate tube which is received through the first open end of said outer tube is closed and the storage compartment is formed by the outer tube between the closed end of said inner tube and the second end of said outer tube; and the relief opening is formed in the otherwise closed end of said inner tube.

6. An elongate shoring device in accordance with claim 1, wherein an elastomeric O-ring is positioned between the inner tube and the outer tube.

7. An elongate shoring device in accordance with claim 1, wherein a flashing is positioned on said inner tube to extend around and beyond the open end of said outer tube.

* * * * *